US006041989A

United States Patent [19]

Kikuchi et al.

[11] Patent Number: 6,041,989

[45] Date of Patent: Mar. 28, 2000

[54] APPARATUS FOR THE TREATMENT OF CLOTH STRIP

[75] Inventors: Koichi Kikuchi; Tadashi Tukamoto, both of Shimada, Japan

[73] Assignee: Kikuchi Kogyo Co., Ltd., Japan

[21] Appl. No.: 08/807,195

[22] Filed: Feb. 27, 1997

Related U.S. Application Data

[63] Continuation of application No. 08/411,741, Apr. 2, 1995, abandoned, which is a continuation of application No. PCT/JP94/01369, Aug. 18, 1994.

[30] Foreign Application Priority Data

Aug. 18, 1993 [JP] Japan ..... 5-204207

[51] Int. Cl.[7] ..... B65H 20/24; D06C 3/00; D02G 1/20

[52] U.S. Cl. ..... 226/104; 226/119; 26/106; 28/220

[58] Field of Search ..... 226/104, 119; 26/99, 106; 38/48, 62

[56] References Cited

U.S. PATENT DOCUMENTS 4,055,612 10/1977 Zimmer ..... 26/106
4,825,517 5/1989 Hagler ..... 28/220
4,967,222 10/1990 Nitsch ..... 226/119

FOREIGN PATENT DOCUMENTS 1089720 7/1959 Germany ..... 226/119
57-95415 6/1982 Japan .
58-92245 6/1983 Japan .
1134845 2/1989 Japan .
1162451 11/1989 Japan .

*Primary Examiner*—Daniel P. Stodola
*Assistant Examiner*—Matthew A. Kaness
*Attorney, Agent, or Firm*—Wall Marjama & Bilinski

[57] ABSTRACT

An apparatus for producing high quality products of cloth strip by the improvement of working efficiency and the equalization of treatment conditions, wherein the cloth strip (2) is subjected to a predetermined treatment while passing through one treatment zone (3) along a spiral path. A plurality of metallic surface rollers (5-2 to 5-4), surfaces of which are formed with metal, are used as at least part of conveying rollers consisting of metallic rollers (5-2 to 5-4) for guiding the cloth strip (2), provided in at least one of entrance and exit parts for the introduction/withdrawal of cloth strip (2) to the treatment zone (3). The metallic surface rollers (5-2 through 5-4) are arranged in a non-contacted state with each other and positively driven to rotate via a suitable drive mechanism (6).

2 Claims, 8 Drawing Sheets

APPARATUS FOR THE TREATMENT OF CLOTH STRIP

This is a Continuation of application Ser. No. 08/411,741 filed Apr. 6, 1995, now abandoned, which is a 371 of PCT/JP94/01369, filed Aug. 18, 1994.

TECHNICAL FIELD

The present invention relates to an apparatus for the treatment of cloth strip, more specifically to an apparatus used in a process for carrying out the dyeing, heat treatment, scouring, finishing or the like of a narrow cloth strip such as a seat belt material.

BACKGROUND ART

In the prior art, when a narrow cloth strip to be used as a safety belt, a seat belt or a sling is subjected to a treatment such as dyeing, heat treatment, scouring or finishing, a plurality of cloth strips run continuously in a side-by-side manner, i.e., in parallel with, through a series of processes, which normally start the supply of greige fabric and include scouring, dyeing, rinsing, drying, heat-setting and the application of a surface agent.

The above technique for treating cloth strips has various problems as follows:

(1) If the running speed of cloth strips arranged in parallel to each other is increased to reduce the treatment time in the respective process, it is necessary to lengthen the running section, which naturally results in an increase in the respective unit size. Such an increase in the unit size causes an uneven temperature distribution in the unit. Particularly, when such temperature difference occurs in the dyeing process, a difference in hue or color density appears in the respective cloth strips running in parallel.

(2) When the cloth strips run parallel to each other, there is a problem of lack of running stability wherein some of the cloth strips may be in a slack state or meander due to a tension variation. If the unit size is enlarged, this tendency would be increased.

(3) Recently there has been a remarkable trend toward smaller lots of diverse sorts and/or multicolor products. Using to the conventional parallel running system, the working efficiency is low because it requires time for each exchange of the dye solution, each alteration of the webbing tension and each change of a process condition such as temperature or speed.

To solve the above problems, the present inventors proposed a treatment method as disclosed in Japanese Unexamined Patent Publication (Kokai) No. 1-34845 "Apparatus for Shifting Running Position of Narrow Width Fabric" wherein a single cloth strip runs along a spiral path in a predetermined treatment zone.

According to this proposal, it is possible to keep a longer length of cloth strip in the predetermined treatment zone, whereby it is possible to shorten the treatment time and remarkably increase the running speed. Thus, the productivity has been improved compared with the conventional parallel running system. In addition, differences in hue, color density, elongation or others have been reduced to stabilize the product quality However, it has been found that there are problems remaining still unsolved, which are as follows:

First, a problem relating to a rubber roller used in the treatment of this type will be discussed. In the prior art, a nip roller device or mangle wherein the surface of roller is formed of rubber is used in an introduction/withdrawal roller device, for introducing/withdrawing a cloth strip, provided at the entrance and exit zones of a unit used for carrying out a thermal treatment, on a narrow cloth strip having a narrow width thereof, such as scouring, dyeing, resin treating or heat-setting. The cloth strip is nipped between a plurality of rollers brought into contact with each other, and introduced into or discharged from the respective unit driven by these rollers.

In the prior art, most of the rubber rollers used for such treatments are made of known rubber materials, such as natural rubber, SBR, NBR, CR (chloroprene rubber), IIR (butylic rubber), FPM, urethane rubber or silicone rubber. Since such rubber rollers are usually disposed near to the entrance and exit zones for the main thermal treatment zone, they are directly influenced by the high temperature in the treatment zone and if the rubber rollers have a low resistance to heat, they are damaged by heat in a short period.

Further, the temperature rise of the rubber roller provided in the exit part of the thermal treatment zone is considerable because the heat-treated cloth strip is withdrawn while being pressingly nipped by the roller surfaces, whereby the deterioration of the rubber is accelerated.

Particularly, in the above system wherein the cloth strip runs along a spiral path, the cloth strip passes over one portion of the introduction/withdrawal roller provided in the thermal treatment zone at a high speed. In a thermosol setter, for example, for carrying out the color development and heat-set, the surface temperature of a cloth strip at a position immediately after the thermal treatment zone is about 180° C. which means that the surface temperature of the withdrawing roller portion supporting the cloth strip also rises to about 180° C. Since the running speed is about 72 m/min, the rubber roller rapidly wears and becomes unusable within a few hours if a conventional rubber roller is used.

Accordingly, it is necessary to frequently replace the rubber roller with new one in the prior art, which results in the complicated replacing operation and an increase in the production cost.

If the thermal treatment is a dyeing or color development process, the rubber roller tends to be contaminated with dyestuff which rubs off onto the dyed product to cause a color change or contamination thereof. To solve such a problem, it is necessary, when a plurality of cloth strips are dyed, that the dyeing order is determined so that a lighter color dye precedes a darker color dye. Also the rubber rollers must be frequently rinsed and, if the contamination of rubber rollers cannot be removed by rinsing, it is necessary to replace the rubber rollers after a period of two or three months, which results in reducing the working efficiency and increasing the production cost.

Next, problems with conveying rollers for the cloth strip used in the thermal treatment zone of this type will be described below.

In the prior art, a plurality of cloth strips run through the heated treatment zone, in parallel, on a plurality of conveying rollers arranged, with a distance therebetween, in the upper and lower areas of a bath. Namely, according to this system, the cloth strips sequentially pass over the respective conveying rollers from the entrance zone to the exit zone.

Therefore, when the cloth strip contracts due to heat, the rotational speed of the respective conveying rollers can vary throughout the thermal treatment zone from the entrance zone to the exit zone, even in a passive manner, in response to a variation in the running speed of cloth strip caused by heat contraction.

However, in the case of the above spiral running, there is an inconvenience in the conventional conveying rollers, as follows:

Usually, in the heat treatment of a cloth strip, the cloth strip gradually contracts due to heat during the first 90 seconds. Particularly, in the thermal treatment in which the cloth strip runs along a spiral path to give the strip a high elongation, it is necessary to allow the cloth strip passing the thermal treatment to contract during the contraction period.

That is, when a cloth strip is introduced into a treatment zone having a capacity for holding the cloth strip for about 180 seconds, and is subjected to a thermal treatment while running along a spiral path, it is necessary to run the cloth strip faster in the first half of the running zone, in which the cloth strip remarkably contracts, than in a second half in which almost no contraction occurs. Otherwise, the contraction generated in the first half of the zone is disturbed.

Actually, even in the first half of the contraction zone, it is necessary to precisely regulate the running speed in response to the contraction of the cloth strip.

In the thermal treatment apparatus wherein a plurality of conveying rollers used in the conventional parallel running system are provided, each formed integrally with a rotary shaft, all the cloth strips running on any one of conveying rollers are driven at the same speed because all portions of this roller have the same rotational speed. Therefore, if the conveying roller of this type is used in the spiral running system, lengthwise portions of the same cloth strip running adjacent to each other and having different contractions may be inhibited from freely contracting due to the friction with the roller, whereby a product having high elongation is not obtainable.

As stated above, the problems to be solved by the present invention, the contamination and lack of durability of rubber rollers, the contamination and lack of durability of introduction and withdrawal rollers in the spiral running system, and the structure of the conveying rollers provided in the thermal treatment zone, remain unsolved in the conventional spiral running system.

DISCLOSURE OF THE INVENTION

An object of the present invention is to solve the above drawbacks in the prior art and provide a thermal treatment apparatus capable of preventing the lowering of working efficiency caused by the replacement of introduction/withdrawal rollers provided in the entrance and exit zones of the respective thermal treatment process zones due to wear or thermal deterioration of rollers, or by the rinsing thereof due to contamination, which apparatus is also capable of producing a high elongation product by preventing the contraction of a cloth strip from being disturbed during the treatment, and of treating cloth strips having wide range elongations, whereby the products having uniform high grade qualities are effectively obtainable at a high rate.

To achieve the above objects, the present invention has the following constitution:

A first aspect of the present invention is an apparatus for treating cloth strips wherein the cloth strips are subjected to a treatment under a predetermined tension while running in parallel to each other or along a spiral path through a treatment zone at a predetermined speed, characterized in that at least part of rollers in introduction/withdrawal roller devices provided in entrance and exit zones used for guiding the cloth strips are metal-surfaced rollers, each having a surface made of metal and arranged so that the surface thereof is not in contact with the surface of the other, and in that the respective metal-surfaced roller is positively rotated by a suitable drive means.

A second aspect of the present invention is an apparatus for treating a single cloth strip wherein the cloth strip is subjected to a treatment in a heated state while running along a spiral path through a treatment zone, characterized in that a plurality of conveying rollers are provided in the treatment zone for forming a predetermined path for the cloth strip and at least part of the conveying rollers have a plurality of divided roller sections mounted in a fixed state or in a freely rotatable state on a common rotary shaft.

A third aspect of the present invention is an apparatus for treating a single cloth strip, characterized in that some of the divided roller sections are coupled to the rotary shaft and a drive means is provided for positively rotating the rotary shaft.

Since the apparatus for treating a cloth strip according to the present invention has the abovesaid constitution, the wear and deterioration of the introduction/withdrawal rollers at the entrance and exit zones of the thermal treatment zone due to high tension and high temperature are completely avoided. In addition, since there is no problem in the application of tension necessary for the treatment of the cloth strip, the drawbacks in the prior art can be solved and the remarkable effects due to the spiral running, such as an improvement in working efficiency, an acceleration of the treating rate or the equalization of treatment conditions in the treatment zone are obtainable. Thus an improvement in the quality of cloth strip is achievable.

Further, according to the apparatus for treating cloth strip of the present invention, since conveying rollers each divided into a plurality of sections and mounted onto the-positively driven common shaft, are used in the treatment zone, it is possible to eliminate friction between the conveying roller and the cloth strip caused by thermal contraction of the cloth strip to be treated, whereby the treatment can be easily carried out even on a highly shrinkable cloth strip.

BEST MODE FOR CARRYING OUT THE INVENTION

Various aspects of the apparatus for treating cloth strips according to the present invention will be described below in detail with reference to the drawings.

Figure 1A:
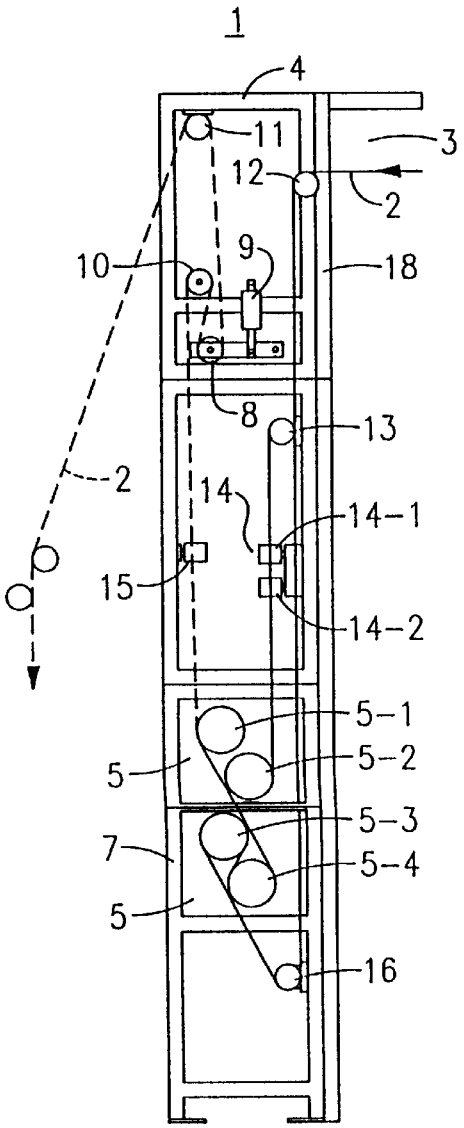
FIGS. 1(A) and 1(B) illustrate an embodiment of a withdrawing part of an apparatus for treating cloth strips according to the present invention.
Figure 1B:
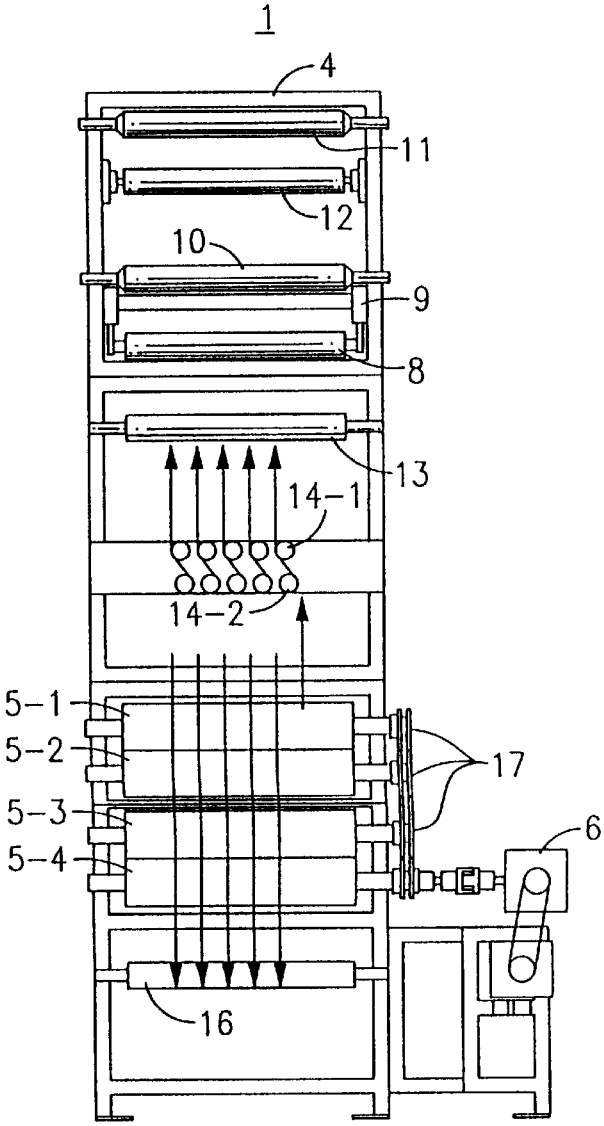

FIGS. 1(A) and 1(B) illustrate side and front views, respectively, of one embodiment of an apparatus 1 for treating cloth strip according to the present invention, wherein an exit part 4 is shown for withdrawing the cloth strip 2 running through a main treatment zone 3 along a spiral path while being subjected to a predetermined treatment.

Figure 8:
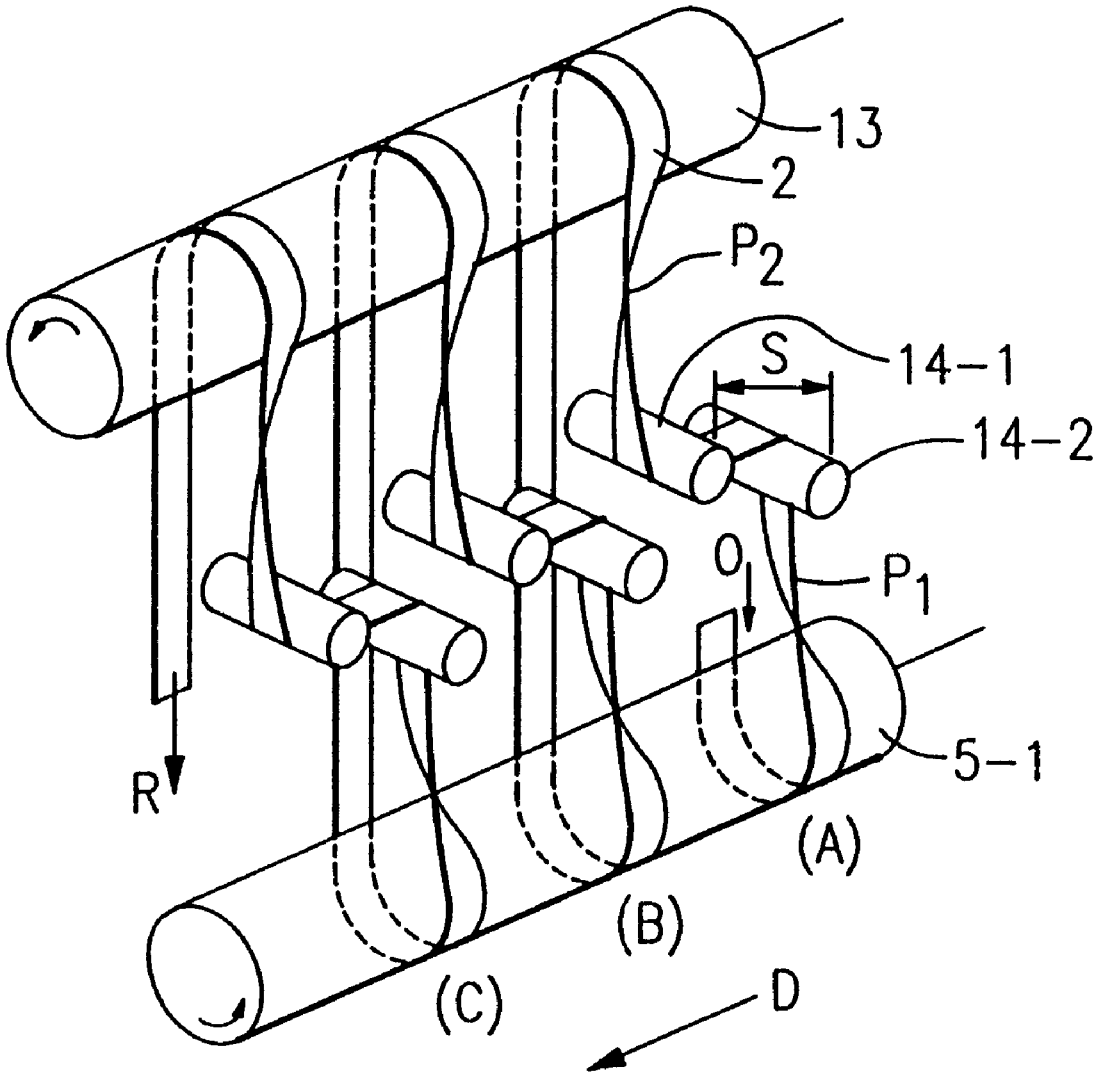
FIG. 8 illustrates a shifting section of the present invention.

In FIGS. 1(A) and 1(B) and FIG. 8, a group of rollers 5 (5-1 through 5-4) consists of metallic surface rollers, at least surfaces of which are formed of metal, and are arranged in a non-contacted state with each other. These metallic surface rollers are positively driven to rotate by a suitable drive means 6.

While there is no detailed illustration in FIGS. 1(A) and 1(B), the main treatment zone 3 is provided on the right side of a frame 18 as shown in FIG. 1(A). When the cloth strip 2 subjected to the predetermined treatment in the main treatment zone 3 emerges therefrom, it is introduced into the exit part 4 via a downward guide roller 12 at O while being deflected downward and via a downward guide roller 13 reaches an upward guide roller 16, at which it reverses the running direction upward and reaches the group of metallic surface rollers 5 (5-1 through 5-4). As shown more particularly in FIG. 8, the cloth strip 2 is twisted at 90° via a pair of shifting rollers 14-1 and 14-2, indicated as P2 and P1, respectively, and reaches again the downward guide roller 13 while being shifted at a predetermined distance (S) in the axial direction (D) of the downward guide roller 13. From the downward guide roller 13, the cloth strip 2 reverses the running direction downward to the upward guide roller 16 and returns to the downward guide roller 13 while shifting the running position thereon via the pair of shifting rollers 14-1, 14-2. Since five pairs of shifting rollers 14-1, 14-2 are provided in the embodiment shown in FIG. 1(B), the cloth strip runs while shifting the running position five times, three shifts (A), (B), (C) being shown in FIG. 8.

Detector of the above system wherein a cloth strip is repeatedly subjected to a predetermined treatment in a so-called "spiral running system", details of which is disclosed in Japanese Unexamined Patent Publication (Kokai) No. 64-34845.

At the final stage of conveyance of cloth strip according to the above spiral running system, the cloth strip 2 is withdrawn at R, away from the final metallic surface roller 5-1, from the exit part 4 of the main treatment zone 3 into the next process via suitable guide rollers 15, 10, a dancer roller 8 for detecting a tension of the cloth strip 2 and a guide roller 11.

The metallic surface rollers 5-1 through 5-4 are respectively driven by a suitable drive means 6 at a predetermined speed. In this regard, rotary shafts of the respective metallic surface rollers are coupled to each other to be rotatable at the same speed by suitable transmission means 17 such as chain, gear or belt.

In FIG. 1(A), reference numeral 9 denotes a pressure-adjustable tension detector such as a hydraulic cylinder for regulating the swing motion of dancer roller 8.

Figure 2:
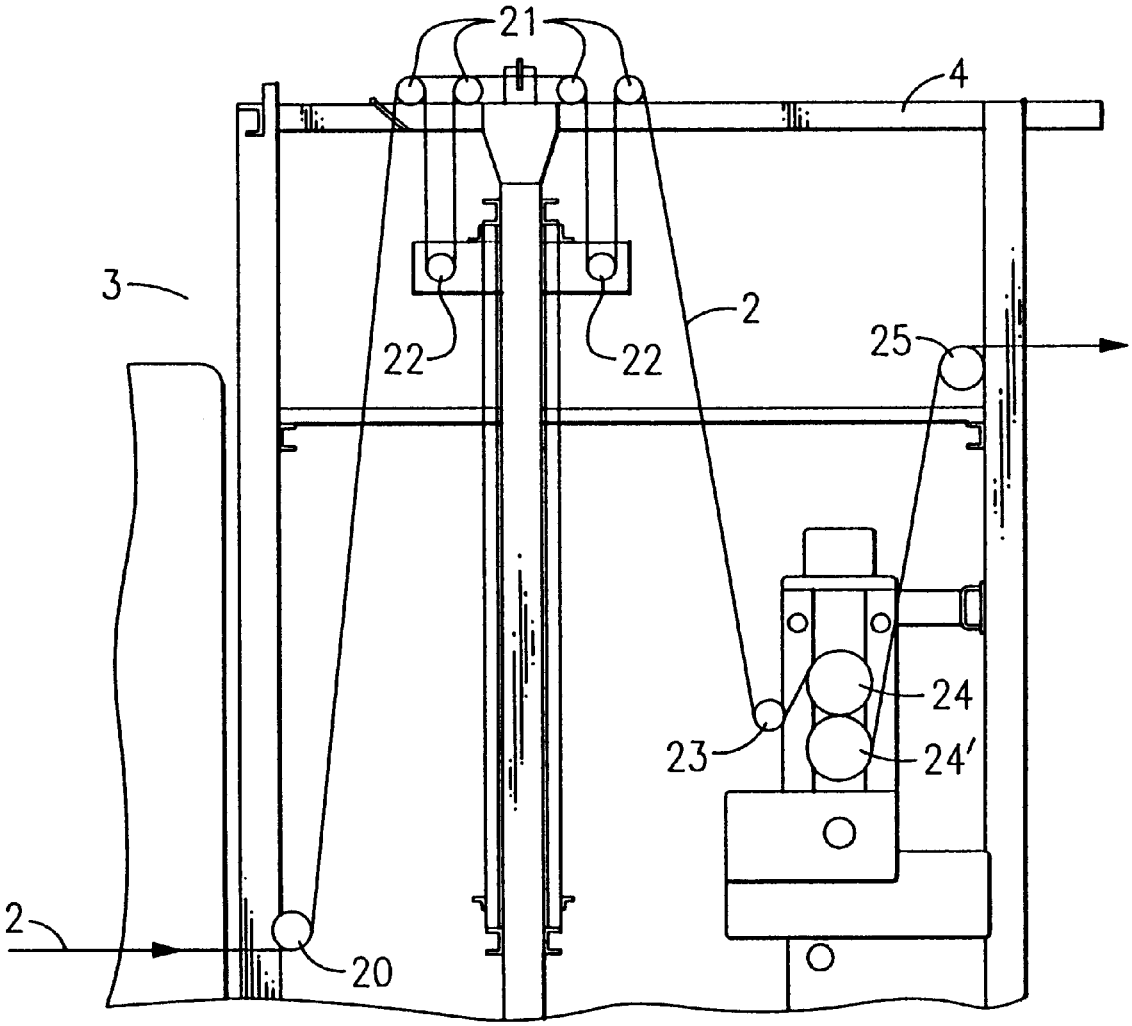
FIG. 2 is a side view of the conventional apparatus for treating cloth strips.

FIG. 2 illustrates nip rollers consisting of the conventional exit part 4 of the treatment zone 3 wherein a cloth strip 2 withdrawn from a guide roller 20 is guided to a nip roller part consisting of a guide roller 23 and a pair of rubber rollers, 24' through a tensioning mechanism consisting of a group of stationary rollers 21 and a group of dancer rollers 22, and after passing through the rubber (nip) rollers, 24', introduced into a predetermined treatment zone 3 via another guide roller 25.

As described above, the pair of nip rollers 24, 24' in the conventional treatment apparatus have surfaces formed of rubber while being in close contact with each other under the predetermined pressure so that the cloth strip to be treated is conveyed while being nipped between the nip rollers 24, 24'.

There are such problems in the above conventional treatment apparatus as described in connection with the prior art. The present invention is constituted to basically have a structure described with reference to FIG. 1 to solve those problems. More specifically, in the treatment zone 3, any one of dye application, color development, thermal treatment or the like is carried out. Particularly, the apparatus according to the present invention is effectively used as a thermosol setter for carrying out the dry heat treatment under a high temperature.

According to the present invention, while the metallic surface rollers 5 must be arranged in a non-contacted state with each other, the distance therebetween may be optionally selected without limitation. Also the number of metallic surface rollers may be optionally selected so that no slip occurs during the conveyance of cloth strip 2 while taking the cloth composition and the facial state of the metallic surface rollers 5 into account.

It is preferable that the metallic surface roller 5 is totally made of metal but may be partially made of metal so that the cloth strip 2 is in contact with that metallic part. At least the surface of metallic surface roller 5 is preferably coated with a hard chromium plating as smooth as possible, favorably in a mirror surface state Since the present invention has such a constitution, during the conveyance of cloth strip along the rollers, the cloth strip is in contact with the metallic surface rollers 5 at a number of points and surfaces, whereby the slip does not occur on the metallic surface rollers 5 even though the surface thereof is in a mirror surface state.

The surface of metallic surface roller 5 is less contaminated compared to the conventional roller, and, even contaminated, it is possible to easily clean the same.

Also it is possible to semipermanently use these metallic surface rollers because the surfaces thereof have a superior resistance to wear and heat.

Since the metallic surface rollers are maintained in a non-contacted state with each other in the present invention, the cloth strip 2 can pass through a gap between the adjacent metallic surface rollers even though the cloth strip 2 is sewn to another cloth strip.

Since the surface of the metallic surface roller 5 is smooth and the roller can contact with the cloth strip with a contact other than point contact, it is possible to conform to a slight elongation or contraction of cloth strip 2 between the adjacent rollers, whereby the cloth strip is not locally compressed, resulting in the improvement of product quality.

Also the metallic surface rollers can bear a heavy load.

That is, in the conventional treatment apparatus of a parallel running type, NBR (copolymer of acrylonitrile/butadiene) having a hardness in a range of 80 through 90 is used as a surface material for the pair of conveying rollers, each having a diameter of 220 mm and to the two rollers usually a pneumatic pressure of 4 kg and a load of 150 kg are loaded.

In the rubber rollers used with such large contact pressures, the surface thereof is liable to be locally deformed when generating an extraordinary force. Contrary to this, since there is no such a deformation in the metallic surface roller, there is no adverse influence on the quality and physical property of the resultant product.

Figure 7:
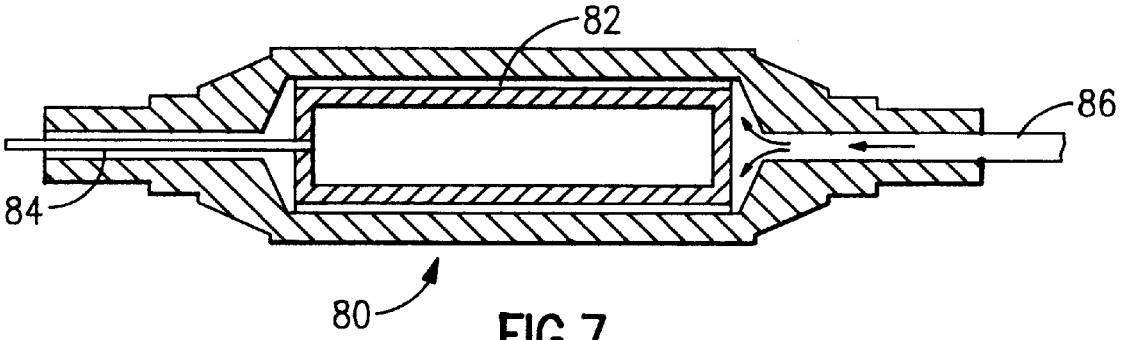
FIG.7 Prior Art
FIG. 7 illustrates a cooling roller.

The metallic surface roller 5 in the treatment apparatus according to the present invention preferably has a cooling means in the interior thereof for cooling the roller surface. In the present invention, any well-known conventional cooling means for cooling the surface of the roller can be used, such as the cooling roller shown in FIG. 7. The cooling roller 80 has an internal water path 82, an inlet 84 for cooling water and an outlet 84 for the cooling water, as is well known in the art.

This is because, when a cloth strip 2 is treated under a high temperature, for example, in a thermosol setter, it is possible to cool the resultant cloth strip heated to high temperature via the metallic surface rollers without additional means for cooling the cloth strip 2, as is the conventional case.

While the apparatus for treating a cloth strip according to the present invention described above is particularly effective for the spiral running system, it is also possible to apply this basic technical idea to the parallel running system.

In the latter case, it is desirable to increase the frictional force between the cloth strip and the metallic surface rollers by providing press rollers for partially pressing the cloth strips 2 onto the metallic surface rollers in the entrance and exit parts for the respective treatment zone 3 or by providing nip rollers for applying a preliminary tension to the cloth strip directly before the metallic roller.

Next, another aspect of the apparatus for treating a cloth strip according to the present invention will be described with reference to FIGS. 3 and 4.

Figure 3:
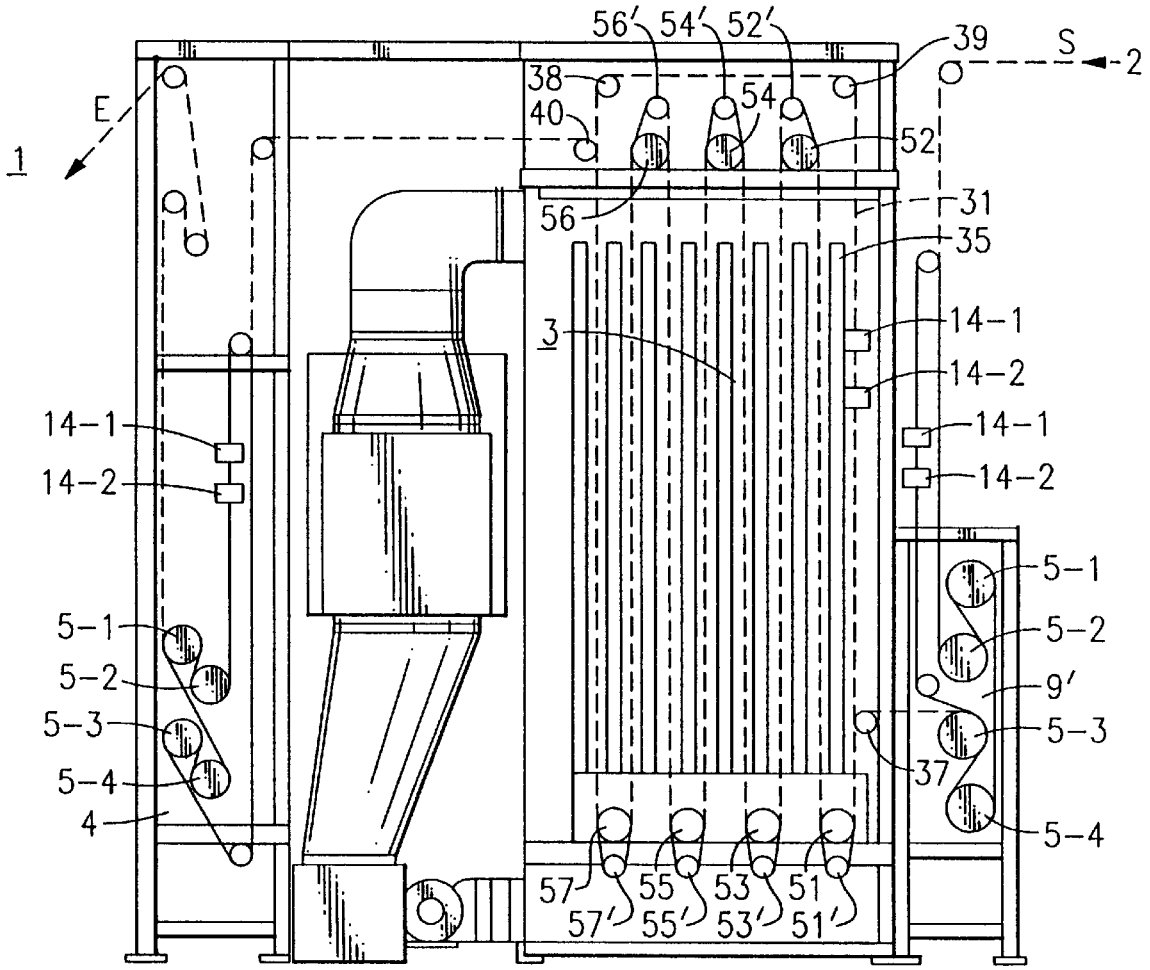
FIG. 3 is a side view of the treating apparatus having an introduction part and withdrawing part according to the present invention on the front and rear sides thereof, respectively.

The second aspect of the present invention is an apparatus 1 for treating a single cloth strip 2 while running the same through a treatment zone 3 along a spiral path as shown in FIG. 3, wherein a plurality of conveying rollers 51 through 57 and a plurality of pairs of shifting rollers 14-1 and 14-2 are provided for forming a predetermined path 31, and drive means 51' through 57' are also provided for positively rotating at least part of the conveying rollers 51 through 57.

In FIG. 3, the treatment zone 3 in which one of various treatments is carried out on the cloth strip has an entrance part 9' and an exit part 4 on the front and rear sides thereof, respectively, having the same structure as the exit part 4 already described with reference to FIG. 1.

FIG. 3 illustrates a thermosol setter wherein the cloth strip 2 is subjected to a predetermined treatment in the entrance part 9', exit part 4 and main treatment zone 3 while running through the respective zones along a spiral path.

In the main treatment zone 3, the running path 31 is formed by deflection rollers 37, 38, 39, 40 and the conveying rollers 51 through 57. Particularly, the conveying rollers 51 through 57 are grouped into upper conveying rollers 52, 54 and 56 and lower conveying rollers 51, 53, 55 and 57 with an intervening heating means 57 therebetween.

The cloth strip to be treated runs between the upper conveying rollers 52, 54 and 56 and the lower conveying rollers 51, 53, 55 and 57 in a zigzag manner and subjected to a predetermined treatment.

When the cloth strip 2 is subjected to the predetermined treatment such as heat treatment while running through the above treatment zone 3, the cloth strip exhibits a thermal contraction behavior which is delicately different from that of others in accordance with the fiber composition, weave structure or yarn density of the cloth strip 2, thermal treatment temperature or others, as described before. Since such thermal behavior is also related to a time factor, it is impossible to take a proper countermeasure to such thermal behavior by passively rotating the conveying rollers of the conventional system.

Figure 4:
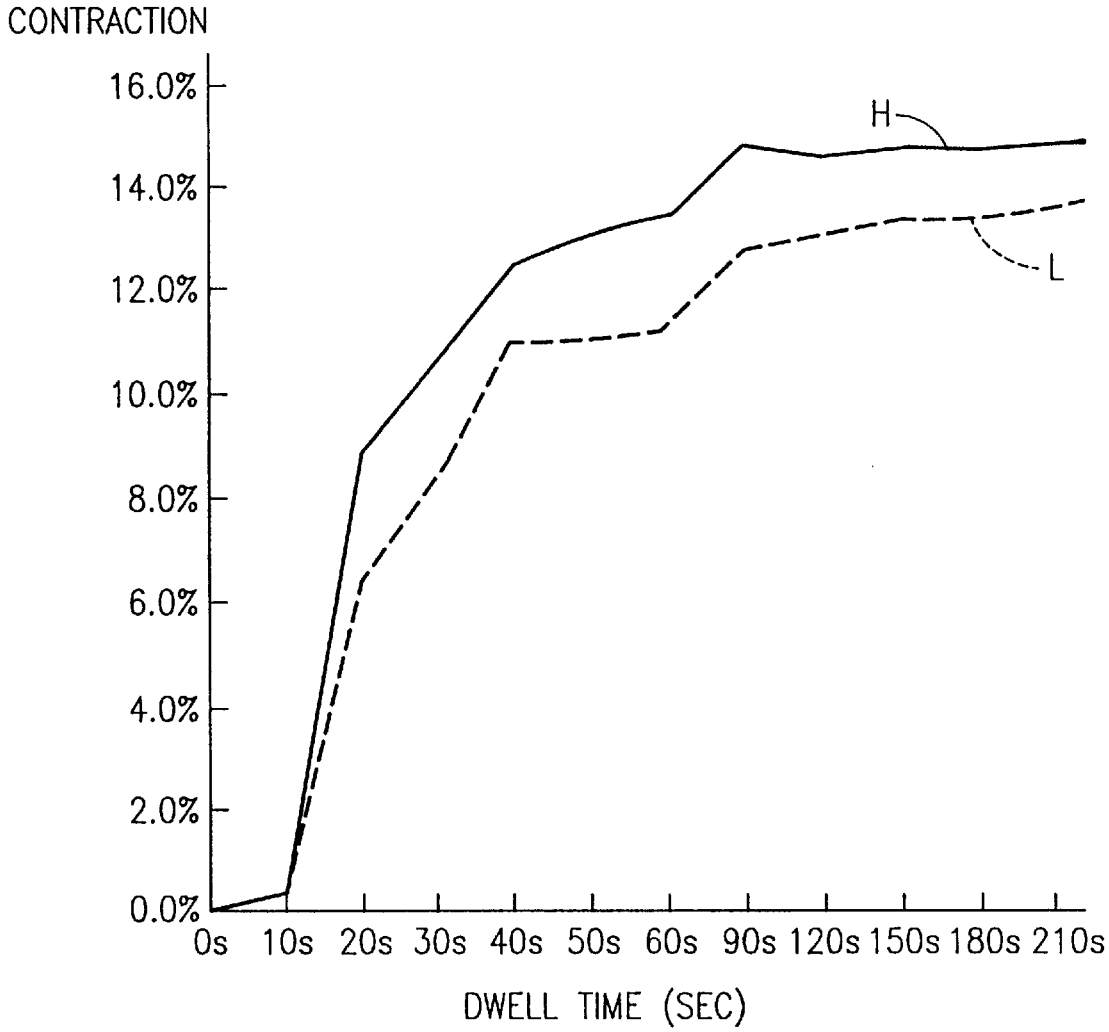
FIG. 4 is a graph illustrating a contraction of cloth strip when treated with dry heat in the treating apparatus according to the present invention.

The present inventors made a study on the relationship between the contraction of cloth strip and the dwelling time of a cloth strip in the treatment zone 3 of thermosol setter while using a cloth strip H (having 15% elongation at 1130 kgf) in a field requiring a high elongation and a cloth strip L (having 5% elongation at 1130 kgf), in a field requiring a low elongation, and obtained a graph shown in FIG. 4.

In this regard, the temperature in the treatment zone 3 is maintained at about 220° C.

It was found therefrom that both of the cloth strips rapidly contract within about 10 seconds through 40 seconds after being introduced into the treatment zone 3; i.e., about 80% of the expected maximum contraction was reached in this period, and the contraction was completed within about 90 seconds.

It is surmise from this result that, if the running speed of the cloth strip at the entrance of the treatment zone 3 is about 72 m/min, the running speed at the exit thereof varies in a range of 68 m/min through 75 m/min due to the contraction of cloth strip.

Accordingly, if the conveying rollers 51 through 57 provided in the treatment zone 3 merely rotate in a passive manner, a frictional force may be generated between the cloth strip 2 and the conveying rollers 51 through 57 and cause the problems described before. According to the present invention, however, such problems can be solved by positively rotating at least some of conveying rollers.

As drive means 51' through 57' used for rotating the conveying rollers, for example, a torque motor is preferably used.

Further, there is no limitation as to which conveying rollers are to be positively driven; i.e., either part thereof or all thereof may be positively driven.

To find that which conveying rollers in the group 51 through 57 should be positively driven for the purpose of obtaining the best result, the test result shown in FIG. 4 was studied again. As a result, it was found that little contraction occurs during the first 10 seconds or so after the cloth strip 2 is introduced into the treatment zone 3 because the cloth strip is still in a cold state, but that the construction progresses quickly during the 10 seconds in 40 seconds or so after the cloth strips in introduced into the treatment zone and reaches about 80% of the expected contraction inherent in the cloth strip after about 150 seconds. Also, it was found that the contraction rate was particularly remarkable during the 10 seconds through 20 seconds or so, after the introduction of cloth strip into the treatment zone 3.

Accordingly, it is desirable that the conveying rollers provided in an area wherein the contraction remarkably occurs are positively rotated while taking the amount of contraction into consideration. That is, it was found that any of the conveying rollers do not need to be rotated in a positive manner in about 10 seconds after the introduction of cloth strip 2 into the treatment zone 3, but is preferably to positively rotate the rollers in a period of about 10 seconds through 40 seconds so that the cloth strip 2 is forcibly conveyed.

For this purpose, the present inventors tested the invention while using the thermosol setter shown in FIG. 3, wherein the conveying rollers 51 through 57 are passively rotated in the conventional manner so that the cloth strip runs along a spiral path. Periods (sec) required for the cloth strip to reach the respective rollers 51 through 57 and lengths (mm) of the cloth strip passing over the respective rollers for these periods were measured. Results thereof were listed in Table 1.

TABLE 1

| | 57 (lower) | 56 (upper) | 55 (lower) | 54 (upper) | 53 (lower) | 52 (upper) | 51 (lower) | |
|---|---|---|---|---|---|---|---|---|
| E- | 174,575 | 170,980 | 167,384 | 163,788 | 160,192 | 156,597 | 153,001 | |
| | 145.48 | 142.48 | 139.49 | 136.49 | 133.49 | 130.50 | 127.50 | series F |
| | 144,147 | 140,551 | 136,955 | 133,359 | 129,764 | 126,168 | 122,572 | |
| | 120.12 | 117.13 | 114.13 | 111.13 | 108.14 | 105.14 | 102.14 | series E |
| | 113,718 | 110,122 | 106,526 | 102,931 | 99,335 | 95,739 | 92,143 | |
| | 94.76 | 91.77 | 88.77 | 85.78 | 82.78 | 79.78 | 76.79 | series D |
| C-7 | 83,289 | 79,693 | 76,098 | 72,502 | 68,906 | 65,310 | 61,715 | ——c-1 |
| | 69.41 | 66.41 | 63.41 | 60.42 | 57.42 | 54.43 | 51.43 | series C |
| | 52,860 | 49,265 | 45,669 | 42,073 | 38,477 | 34,882 | 31,286 | ——b-1 |
| | 44.05 | 41.05 | 38.06 | 36.06 | 32.06 | 29.07 | 26.07 | series B |
| | 22,432 | 18,836 | 15,240 | 11,644 | 8,049 | 4,453 | 857 | |
| | 18.69 | 15.70 | 12.70 | 9.70 | 6.71 | 3.71 | 0.71 | series A–S |
| | | | b-4 | a-4 | a-3 | b-3 a-2 | b-2 | a-1 |

The above table shows the results of measurement when the cloth strip 1 was introduced into the thermosol setter 3 of FIG. 3, wherein the internal temperature is maintained at 220° C., at a speed of about 71.6 m/min.

The cloth strip 2 was supplied to the treatment zone 3 from an entrance part S in FIG. 3 and passed over the group of conveying rollers 51 through 57 in a meandering manner in the upward and downward directions (this is called as a first passage and referred to as series A in Table 1). Thereafter, the cloth strip 2 returned to the initial conveying roller 51 and a second passage was repeated between the conveying rollers 51 through 57 in a similar manner as the first passage. This is referred to as series B in Table 1.

Such a spiral running system is described in the aforesaid Japanese Examined Patent Publication (Kokai) 64-34845.

The cloth strip 2 is circulated through the same treatment zone 3 while similarly repeating the above path a further five times (series C through series F) and was withdrawn from an exit part E.

Column a-1 in Table 1 shows the measurement data when the cloth strip 2 reached the first conveying roller 51 provided in the lower area of the treatment zone 3 during the first spiral passage after passing the entrance part S, wherein a period (sec) required for the cloth strip 2 to reach the roller 51 is shown in the lower section and a length (mm) of cloth strip 2 moved during this period is shown in the upper section.

Similarly, column b-4 shows a period (seconds) required for the cloth strip 2 to reach the second conveying roller 54 provided in the upper area of the treatment zone 3 after passing over the entrance part S and the length (mm) thereof moved during this period.

According to Table 1, it is apparent that the position of a cloth strip 2 ten seconds after introduction into the treatment zone 3 is at the conveying roller 55 during the first spiral passage, and that a position corresponding to 40 seconds is at the conveying roller 56 during the second spiral passage. As stated before, a remarkable contraction occurs in the short period between 10 seconds and 40 seconds.

Accordingly, the conveying roller 56 is preferably positively driven and, more preferably, the conveying rollers 52 and 54 are also positively driven for the purpose of distributing the influence of contraction while taking into account the variation of contraction shown in FIG. 4.

Based on such a view point, the present inventors experimented with the positively driven speed, and the results are listed in Table 2.

TABLE 2

| Position of Roller | Rotational Speed | Peripheral Speed |
|---|---|---|
| Entrance (S) | 91.2 rpm | 71.6 m/min |
| 56 | 113.6 rpm | 71.4 m/min |
| 52 | 112.0 rpm | 70.4 m/min |
| 54 | 111.0 rpm | 69.7 m/min |
| 57 | 110.3 rpm | 69.3 m/min |
| 55 | 110.0 rpm | 69.1 m/min |
| 53 | 110.0 rpm | 69.1 m/min |
| 51 | 110.0 rpm | 69.1 m/min |
| Exit (E) | 110.0 rpm | 69.1 m/min |

These data in Table 2 were obtained when a high elongation cloth strip having an elongation of 15% is subjected to a thermal treatment at a feed ratio of −3.5% resulted from an introduction speed of 71.6 m/min and a withdrawal speed of 69.1 m/min in the thermosol setter shown in FIG. 3 wherein the inner temperature is maintained at 230° C. and the conveying rollers 51, 53, 55, 57 are passively driven while the conveying rollers 52, 54, 56 are positively driven at a speed higher than that of the rollers 51, 53, 55, 57.

In this connection, all the conveying rollers have identical diameters.

The rotational speed of an introduction roller in the entrance part of the treatment zone 3 is set at 91.2 rpm so that the peripheral speed thereof is 71.6 m/min, while a withdrawal roller in the exit part of the treatment zone 3 is set at 110.0 rpm so that the peripheral speed thereof is 69.1 m/min. The conveying rollers 52, 54, 56 were driven by torque motors set at 140 V and the rotational speeds thereof were adjusted in a usual manner so that the conveying roller 52 is driven at the rotational speed of 112.0 rpm and the peripheral speed of 70.4 m/min; the conveying roller 54 at 111.0 rpm and 69.7 m/min; and the conveying roller 56 at 113.6 rpm and 71.4 m/min.

Due to such the adjustment, the passive conveying rollers 51, 53 and 55 were driven at a rotational speed of 110.0 rpm and a peripheral speed of 69.1 m/min but the conveying roller 57 was driven at a rotational speed of 110.3 rpm and a peripheral speed of 69.3 m/min.

In the above measurement, the temperature of cloth strip 2 was 200.2° C. and the tension thereof was 78 kg during the measurement.

According to the present invention, it is possible to obtain a product having higher elongation and quality by further developing the above technology while taking the delicate contraction behavior of the cloth strip 2 into account.

An embodiment of the invention will be described as a third aspect with reference to FIGS. 5 and 6.

The conveying rollers 51 through 57, at least part of which are provided with means 51' through 57' for positively driving the same, are structured so that a plurality of divided roller sections are mounted onto a common rotary shaft in a fixed manner or a freely rotatable manner relative to the shaft. All the divided roller sections may be rotatable, while some of them may be fixedly coupled to the shaft if necessary. In order to conform to various contraction behaviors of the cloth strips, the latter mechanism is preferable.

Figure 5:
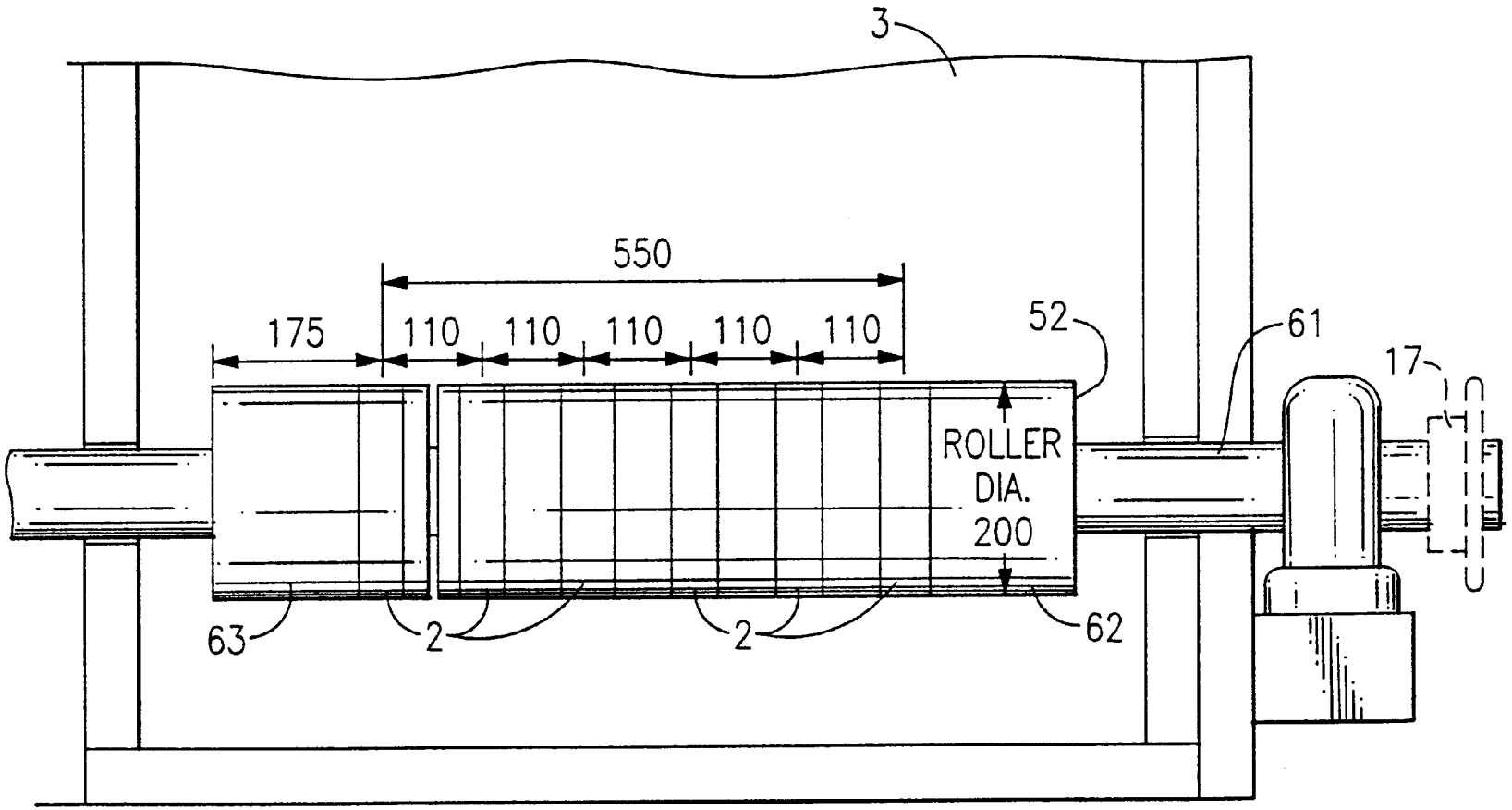
FIG. 5 illustrates a structure of conveying roller provided in the treating apparatus according to the present invention, which is divided into sections and having a positive drive mechanism.

As shown in FIG. 5, the conveying roller 52 is divided into at least two sections 62, 63, and the one section 62 is fixedly mounted to the rotary shaft 61, to which is fastened a driving member 17 engaged with one of driving means 51' through 57'. On the other hand, the other section 63 is mounted to the rotary shaft 61 in a passively rotatable manner.

In FIG. 5, the conveying roller 52 is structured so that the cloth strip 2 running along a spiral path is made to pass five times over the roller section 62 fixed to the rotary shaft, while passing only once over the passively rotated roller section 63. Such a structure is one of embodiments of the conveying roller according to the present invention, in which the divided areas or the number of the conveying rollers, or the times the cloth strip passes over the roller can be optionally selected.

Figure 6A:
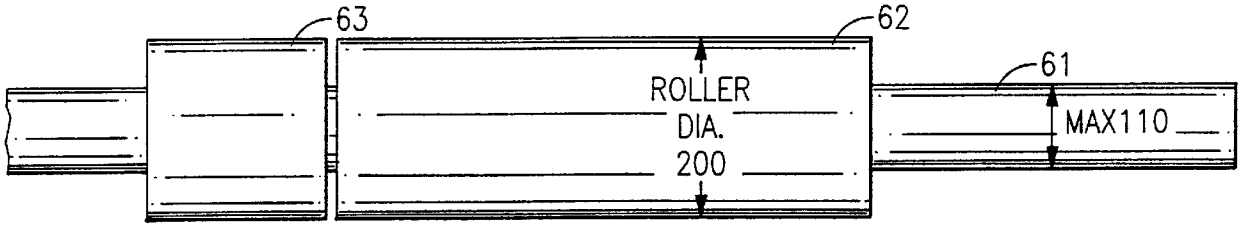
FIGS. 6(A) through 6(C) illustrate embodiments of the divided conveying roller, respectively, used in the apparatus for treating cloth strips according to the present invention.
Figure 6B:
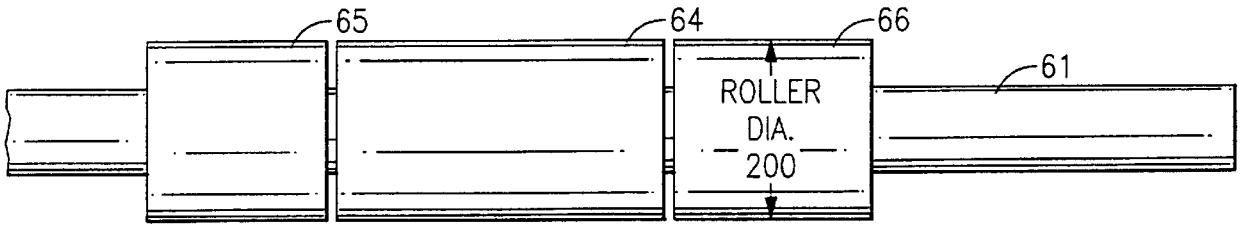
Figure 6C:
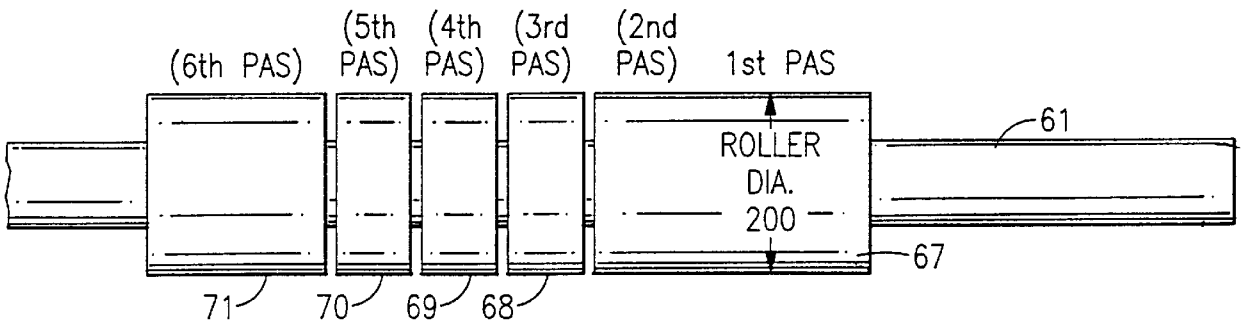

FIGS. 6(A) through 6(C) illustrate other embodiments of the conveying roller according to the present invention. FIG. 6(A) coincides with the above embodiment shown in FIG. 5. In FIG. 6(B), the conveying roller is divided into three sections wherein a middle section 64 is fixedly mounted to the rotary shaft 61 and side sections 65, 66 are structured as passively rotatable rollers. In this connection, the divided lengths of the conveying roller may be optionally selected.

In FIG. 6(C), the conveying roller is divided into five sections wherein the right end section 67 is fixedly mounted to the rotary shaft 61 and the remaining sections 68 through 71 are passively rotatable rollers. Of course, the lengths of the respective sections can be optionally selected.

With reference to data listed on Table 1, it is favorable to adopt the roller shown in FIG. 6(C) as the conveying roller 56 while adjusting the width of the fixedly mounted section 67 so that the cloth strip 2 can pass thereover during the first and second passages of the spiral path.

According to the present invention, since the resistance to wear and heat of rollers is semipermanently maintained at a high level by the use of metallic surface rollers, the spiral running system can be successfully put into practice. Also it is possible to completely conform to any contraction behaviors of the cloth strip by the use of positively rotatable divided conveying rollers. Thus it is possible to completely solve the problems of the prior art and provide a small-sized apparatus for treating cloth strips at a high rate, from which a high grade product with uniform qualities is effectively obtainable at a lower cost.

Further according to the present invention, almost all cloth strips including both lower and higher elongation strips can be treated without any limitations.

In addition, according to the present invention, for example, a seat belt webbing of a high elongation type having an elongation of more than 17% and reaching 22% under a load of 1130 kgf, can be treated.

We claim:

1. An apparatus for treating cloth strips having a narrow width dimension wherein said cloth strips are subjected to treatment under a predetermined tension while running in paths through a treatment zone at a predetermined speed, the apparatus having introduction roller devices and withdrawal roller devices, wherein at least one of said introduction roller devices and withdrawal roller devices is provided between a pair of guide rollers in at least either one of an entrance area and an exit area of said cloth strips treatment zone and used for conveying said cloth strips, the rotational axis of any one of said rollers of said introduction roller devices and withdrawal roller devices being parallel to the rotational axes of said pair of guide rollers, and wherein at least part of said rollers of said introduction roller devices and said withdrawal roller devices are metallic surface rollers, which are parallely and adjacently arranged to each other but not in contact with each other, wherein said metallic surface rollers are positively driven to rotate by a suitable drive means, said apparatus including at least one pair of shifting rollers linearly disposed between one of said guide rollers and said introduction roller devices and said withdrawal roller devices, said at least one pair of shifting rollers having rotational axes perpendicular to the rotational axes of said metallic surface rollers, for causing cloth strips traversing a first path to be twisted by 90 degrees about their narrow width dimension at an entrance region and an exit region of said at least one pair of shifting rollers, said at least one pair of shifting rollers being spaced relative to the rotational axes of said guide rollers and said metallic surface rollers to cause said cloth strips to travel over the surfaces of said metallic surface rollers in a spiral configuration.

2. An apparatus for treating a cloth strip or strips as defined by claim 1, the metallic surface roller has an interior portion, and further has a means for cooling, located in the interior for cooling the metallic surface roller.

* * * * *